US005956796A

United States Patent [19]

Lodato

[11] Patent Number: 5,956,796

[45] **Date of Patent: *Sep. 28, 1999**

[54] PERSONAL HYGIENE IMPLEMENT CONSTRUCTION

[75] Inventor: Franco Lodato, Norwood, Mass.

[73] Assignee: Gillette Canada Inc., Kirkland, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/833,099

[22] Filed: Apr. 4, 1997

[51] Int. Cl.[6] ..... A46B 9/04; A46B 5/02

[52] U.S. Cl. ..... 15/167.1; 15/143.1; 248/910

[58] Field of Search ..... 15/143.1, 167.1, 15/227; 248/364, 910; 433/216

[56] References Cited

U.S. PATENT DOCUMENTS

| | | | |
|---|---|---|---|
| 442,510 | 12/1890 | Burton | 15/143.1 |
| 524,894 | 8/1894 | Forsberg | 248/910 |
| 774,558 | 11/1904 | Browne | 15/227 |
| 1,048,778 | 12/1912 | Wood | 15/143.1 |
| 1,051,815 | 1/1913 | Morgan | 15/143.1 |
| 1,593,763 | 7/1926 | Henderson . | |
| 1,690,311 | 11/1928 | Reich | 248/910 |
| 4,033,007 | 7/1977 | Hadary . | |
| 4,035,865 | 7/1977 | McRae et al. . | |
| 4,106,152 | 8/1978 | Hadary . | |
| 4,265,560 | 5/1981 | Spica . | |
| 4,523,599 | 6/1985 | Collet . | |
| 5,353,464 | 10/1994 | Atkins . | |

FOREIGN PATENT DOCUMENTS

| | | | |
|---|---|---|---|
| 2 654 314 | 5/1991 | France . | |
| 296 19 569 U1 | 5/1997 | Germany . | |
| 180027 | 10/1935 | Sweden . | |
| 8401700 | 5/1984 | WIPO | 15/167.1 |
| 9107114 | 5/1991 | WIPO | 15/167.1 |

*Primary Examiner*—Randall E. Chin
*Attorney, Agent, or Firm*—Fish & Richardson P.C.

[57] ABSTRACT

A personal hygiene implement, such as a toothbrush, is constructed to have a self-righting tendency to elevate a portion of the implement to avoid contamination from a support surface upon which it rests. The implement includes a functional head and a handle having a curved outer surface. When placed upon a horizontal surface on the curved outer surface, the implement rolls under gravitational force to a stable position in which the head is not in contact with the horizontal surface. In some cases a ballast material offsets the gravitational center of the implement to increase the self-righting tendency. Barrel-shaped, bulb-shaped and cylindrical handles are disclosed, as is a method of use.

20 Claims, 2 Drawing Sheets

PERSONAL HYGIENE IMPLEMENT CONSTRUCTION

BACKGROUND OF THE INVENTION

The present invention relates generally to personal hygiene implements (e.g. toothbrushes and shaving razors).

Toothbrushes and shaving razors commonly have an elongated handle with a brush head or blade disposed at one of the ends of the handle. Between uses, they are typically placed either in a holder of some sort or on a handy surface, such as the edge of a sink or the shelf of a nearby medicine cabinet.

SUMMARY OF THE INVENTION

Some market research has suggested that among the concerns of toothbrush users is that of potential contamination of the head of the toothbrush by incidental contact with the surface upon which the toothbrush is placed between uses. The present invention addresses this concern by providing a self-righting toothbrush construction that locates the head of the toothbrush (i.e. the portion of the toothbrush with bristles) away from the flat surface upon which the toothbrush rests. By the term "self-righting" it is meant that the toothbrush will tend to gravitate toward a predetermined, righted position on a flat surface, due to its construction. This construction is also applicable to other personal hygiene implements, such as shaving razors.

According to one aspect of the invention, a toothbrush has a head with a brush portion, and a handle with a curved outer surface extending about a portion of the perimeter of a cross-section of the handle. The toothbrush, when placed upon a horizontal surface on the curved outer surface of the handle, rotates upon the curved outer surface under gravitational force to a stable position in which the head is not in contact with the horizontal surface upon which it is placed.

In a preferred embodiment, the portion of the perimeter about which the curved outer surface extends includes at least about fifty percent of the perimeter.

In some cases the part of the curved outer surface in contact with the horizontal surface in the stable position has a center of curvature, the toothbrush having a gravitational center between the curved outer surface and the center of curvature.

In some embodiments the handle is elongated and has two ends, the head being at one end of the handle. In some of these embodiments the handle has a barrel-shaped section between the two ends, the barrel-shaped section having a substantially circular transverse cross section of greatest diameter. The gravitational center and the head are on opposite sides of the cross section to elevate the head with the toothbrush at rest upon the horizontal surface. In some other embodiments the handle has a substantially cylindrical shape or is bulb-shaped.

In some constructions, the brush portion has extending bristles.

In some arrangements, the head and the handle comprise a molded polymer and the handle has a ballast. In some of these arrangements the handle has a cavity and the ballast is located within the cavity. Preferably, the ballast comprises a material that has a material density at least about 20% greater than the material density of the molded polymer.

In some instances the ballast comprises a polymer in molded form, or a gel or metal.

In the presently preferred arrangement, the molded polymer is from the group consisting of polypropylene, nylon and low-density polyethylene and the ballast comprises a material selected from the group including high-density polyethylene, polyester and metals.

In some constructions, at least a portion of the curved outer surface comprises the ballast.

In some embodiments, the handle has a hollow portion between the gravitational center and the head.

According to another aspect of the invention, the toothbrush has its gravitational center near the curved outer surface of the handle such that a line through the gravitational center that extends, in a transverse cross-section of the handle, in one direction through a point on the outer surface closest to the gravitational center, extends in the opposite direction toward the head of the toothbrush. The toothbrush, when placed upon a horizontal surface on the curved outer surface, rotates upon the curved outer surface under gravitational force to a stable position upon the point in which the head is not in contact with the horizontal surface.

In some embodiments, the line extends in the direction of the bristles of the brush.

According to another aspect of the invention, a method of brushing teeth is provided, comprising the steps of (a) grasping a toothbrush as described above, and (b) brushing teeth with the toothbrush.

According to another aspect of the invention, a personal hygiene implement has a first region and a second region spaced from the first region. The second region defines a curved outer surface, and the implement, when placed with the curved outer surface engaged upon a horizontal support surface, rotates upon the curved outer surface under gravitational force to a stable position with the first region spaced from contact with the horizontal support surface.

In some embodiments the first region comprises a portion of the implement intended to contact a portion of a user's body in use.

The construction of the toothbrush of the invention can decrease the risk of potential contamination from the horizontal surface upon which the toothbrush is placed between uses, due to the resulting location of the head of the toothbrush away from the surface. Similar advantages can be obtained by applying this construction to a shaving razor or other personal hygiene implement having a portion which contacts the user's body in use, the cleanliness of which portion it is desirable to maintain.

DESCRIPTION OF PREFERRED EMBODIMENTS

Figure 1:
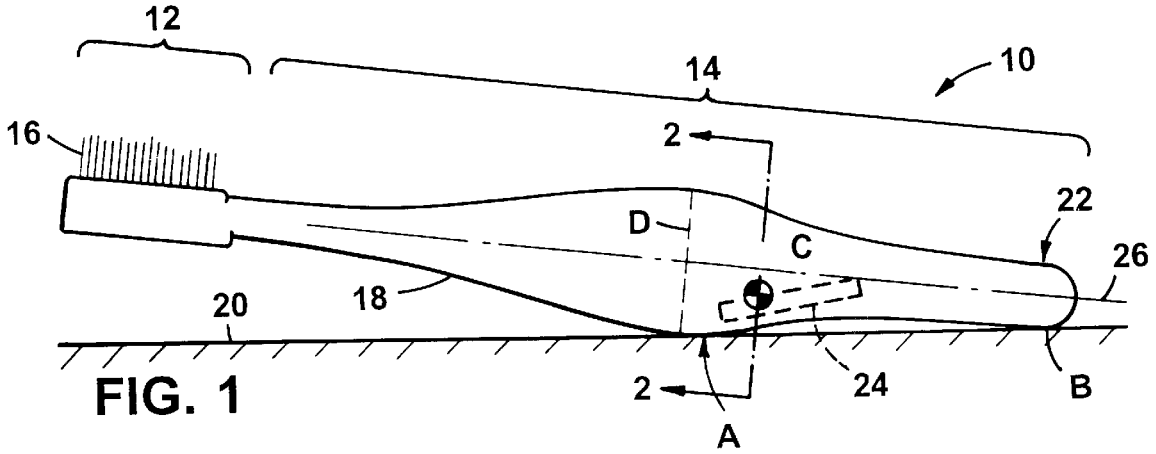
FIG. 1 is a side elevational view of one embodiment of a toothbrush, according to the invention.

Referring to FIG. 1, a toothbrush 10 has a head 12 and a handle 14. Head 12 has typical bristles 16 for brushing teeth extending, in the embodiment shown, from one side of head 12. Handle 14 is shaped to provide a comfortable grip.

Of particular importance, handle 14 has a curved outer surface 18 upon which the toothbrush normally rests when placed upon a flat surface 20. Toothbrush 10 is constructed such that its center of gravity (i.e. gravitational center) C is located with particular relation to curved surface 18 (as will be described later) to give the toothbrush a self-righting tendency.

FIG. 1 shows toothbrush 10 at rest on a smooth, flat surface 20. In this first embodiment, handle 14 has substantially circular cross-sections in planes perpendicular to its longitudinal axis 26 (see, e.g., FIGS. 2A–2C). Curved surface 18 contacts surface 20 at point A, near the cross-section D of greatest diameter, and at point B, near the tail end 22 of the handle. Resting upon more than one point provides some stability to keep the toothbrush from tilting (i.e. rotating in a vertical plane containing axis 26), although it is not a necessary feature for self-righting.

Gravitational center C is located on the side of cross-section D opposite head 12, between points A and B. The barrel shape of handle 14 of this embodiment, given this location of gravitational center C, elevates head 12 to keep the head from contacting surface 20. In some embodiments handle 14 includes a ballast 24, of heavier material than the materials of the rest of the handle, positioned generally tail-ward of section D to result in a desired positioning of gravitational center C. Ballast 24 is preferably a material with a material density at least 20% greater than the material density of the material forming the bulk of the handle to produce a substantial offset in the location of gravitational center C. In the presently preferred construction, ballast 24 is a metal insert which is fully encapsulated by the surrounding handle material.

Axis 26 passes through the geometric centers of the perpendicular cross-sections of handle 14, and can therefore be considered, in this embodiment, a center of curvature for curved outer surface 18. Gravitational center C is on one side of axis 26 and bristles 16 extend away from axis 26, from a surface of head 12, on the other side of axis 26. In the figure, toothbrush 10 is shown at rest, with C below axis 26 and bristles 16 pointing upward.

Figure 2A:
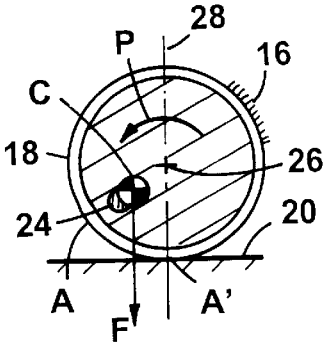
FIGS. 2A–2C are cross-sectional views taken along line 2—2 in FIG. 1, illustrating a self-righting effect.
Figure 2B:
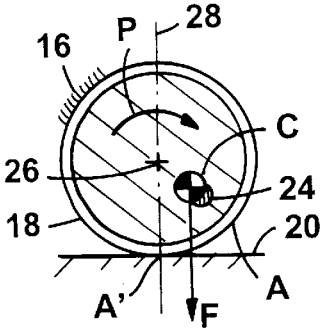
Figure 2C:
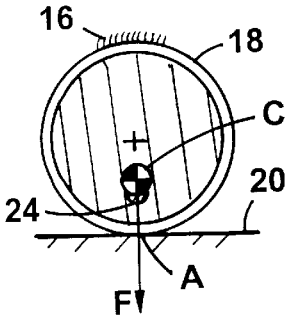

Referring to FIGS. 2A through 2C, this arrangement of gravitational center C with respect to axis 26 and bristles 16 results in a self-righting tendency. In other words the toothbrush, when placed on surface 20 with the gravitational center displaced to one side of the vertical plane 28 containing surface contact point (i.e. instantaneous center of rotation) A' and axis 26 (e.g. as shown in FIGS. 2A or 2B), the toothbrush will roll, in the direction indicated by arrow P due to a moment created by gravitational force F about instantaneous center of rotation A', to position bristles 16 in a desired orientation (e.g., pointing upward, away from surface 20, as shown in FIG. 2C). At rest with gravitational center C below axis 26, bristles 16 extend generally upward in the direction of plane 28.

Figure 3:
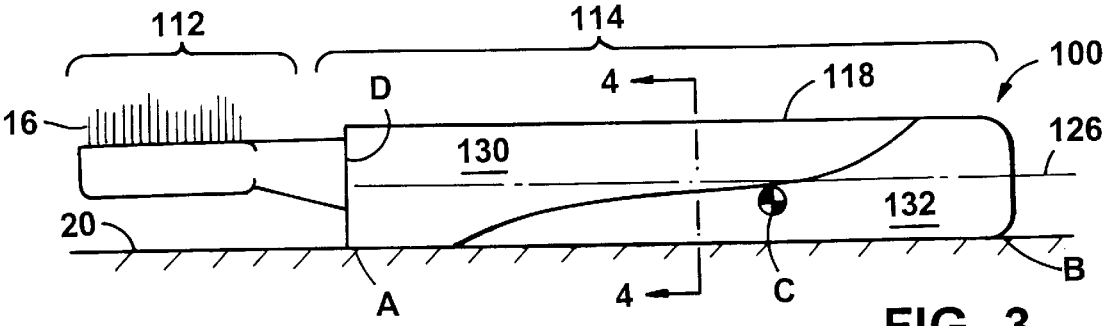
FIG. 3 is a side elevational view of a second embodiment of the toothbrush.
Figure 4:
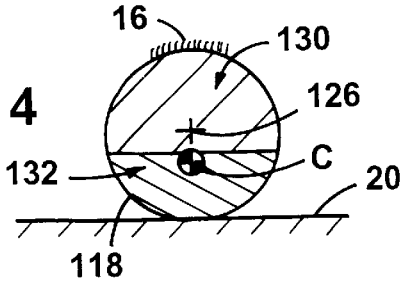
FIG. 4 is a cross-sectional view taken along line 4—4 in FIG. 3.

Referring to the embodiment shown in FIGS. 3 and 4, toothbrush 100 has a generally cylindrical handle 114 with a curved outer surface 118. As in the embodiment of FIG. 1, gravitational center C is below axis 126 and bristles 16 extend upward when toothbrush 100 is at rest. As described above with reference to FIGS. 1–2C, this construction advantageously positions bristles 16 away from surface 20, which they would tend to rest against if gravitational center C were positioned along longitudinal axis 126 or on the same side of the axis as the head.

Handle 114 includes two sections, 130 and 132. Section 132 is made of a heavier material than section 130. The arrangement of these two sections, with section 132 disposed generally to one side of axis 126, results in the gravitational center C being offset from the axis to provide the self-righting tendency discussed above. In the presently preferred construction, section 130 is made of a molded polymer with a relatively low material density, such as polypropylene, nylon, or low-density polyethylene. Section 132, a ballast, is preferably molded from high-density polyethylene or polyester.

Sections 130 and 132 together have a curved outer surface 118 upon which toothbrush 100 can roll to its desired orientation. In this second embodiment, tilt stability is provided by contact with surface 20 over a substantial length of handle 114. For purposes of applying the description of the mechanics of self-righting made above with reference to FIGS. 1–2C, cross-section D is considered to be the cross-section of maximum diameter that is nearest to head 112. Points A and B are considered to be at either end of the contact length L, as shown.

Figure 5:
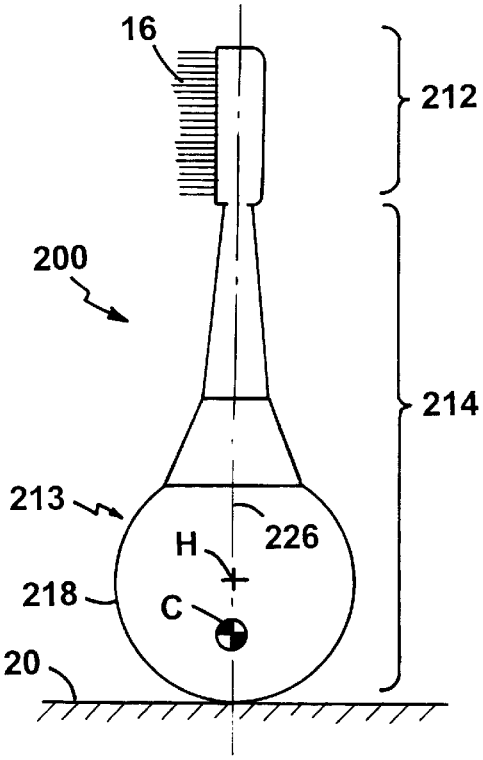
FIG. 5 is a side elevational view of a third embodiment of the toothbrush.

Referring to the embodiment shown in FIG. 5, a toothbrush 200 has a brush head 212 and a bulb-shaped handle 214. The distal portion 213 of handle 214 is substantially spherical, with a geometric center H. Gravitational center C and head 212 are on opposite sides of geometric center H along longitudinal axis 226. The effect of this construction is to cause head 212 to be located away from surface 20 when toothbrush 200 is at rest, as discussed above with respect to the embodiments shown in FIGS. 1–4, although in this embodiment bristles 16 do not extend upward with the toothbrush in its upright position. Ballasting, e.g., by any of the means disclosed with respect to FIGS. 1–4, is employed to offset the weight of head 212 to result in the desired positioning of gravitational center C.

Figure 5A:
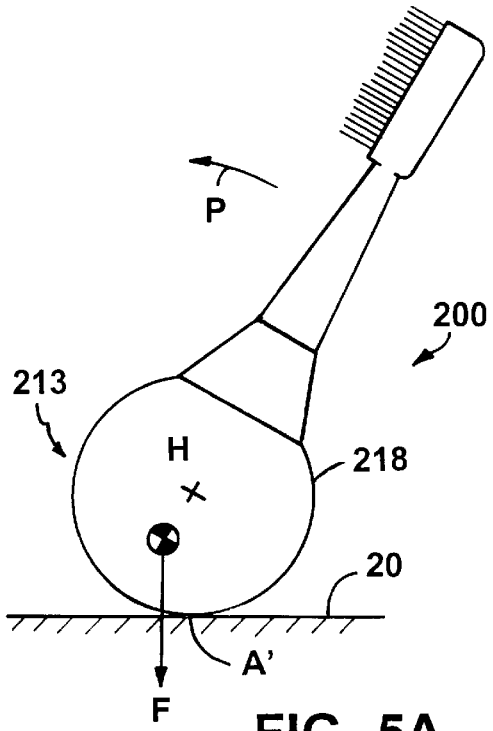
FIG. 5A shows the toothbrush of FIG. 5 in an unbalanced position.

As shown in FIG. 5A, when toothbrush 200 is placed on flat surface 20 upon curved surface 218, the toothbrush rolls to an upright position due to a moment about instantaneous center of rotation (and contact) A' caused by gravitational force F.

Figure 6A:
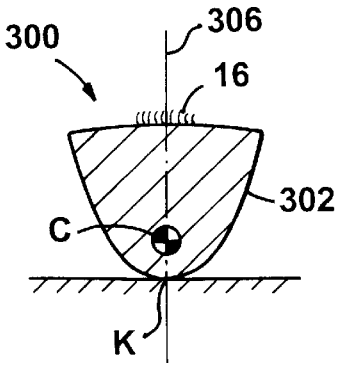
FIGS. 6A–6B illustrate cross-sectional shapes of some further embodiments.
Figure 6B:
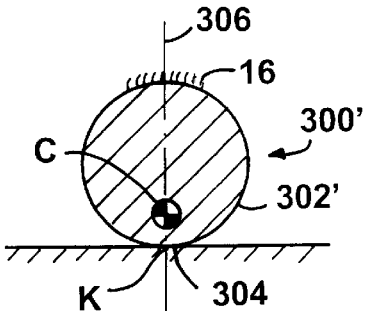

Referring to FIGS. 6A and 6B, the above-described kinetic principles involved in self-righting are not limited to devices with circular cross-sections. Devices with other cross-sections can be constructed to provide a limited self-righting tendency that will right the toothbrush from any rotated position within a reasonable range of positions in which the toothbrush would be likely to be set down. The transverse cross-section (300 or 300') of the part of the toothbrush that would contact flat surface 20 upon which the toothbrush is set should include a curved outer surface (302 or 302') that extends about at least 50 percent of its perimeter. It is not necessary that the curved surface (302 or 302') extend about the entire perimeter of the cross-section. In fact, in some arrangements it is advantageous to have a small flat 304 on the outer surface near the gravitational center C to provide a more stable rest position. It is also not necessary that curved surface (302 or 302') extend along the entire length of the handle. The curved surface need only extend over a portion of the length that contacts surface 20, provided the outer surfaces of the rest of the handle are arranged so as to not inhibit the self-righting rotation of the toothbrush. In other words, curved surface (302 or 302') is arranged such that any non-curved portions of the handle that could otherwise interfere with the rotation of the toothbrush on surface 20 do not contact surface 20 in a way that would impede rotation as the toothbrush rolls over the extent of the curved surface.

To describe this self-righting construction another way, consider line 306 shown in the transverse cross-section of FIG. 6A. In order for the head of the toothbrush to be located upward, away from surface 20 by the self-righting tendency of the toothbrush, gravitational enter C is located such that a line 306 through C that extends, in one direction, through a point K on the curved outer surface 302 closest to C extends, in the other direction, toward the head of the toothbrush. With the head on the opposite side of C as the point on surface 302 closest to C, the head is located desirably upward when the toothbrush has rotated to place gravitational center C at its lowest position, closest to surface 20.

This relative arrangement of the head, gravitational center C and outer curved surface can also be found in embodiments having handles with circular cross-sections, e.g., as shown in FIGS. 1–5. Preferably, line 306 extends in the direction of bristles 16, although this is less critical in the embodiments of FIGS. 1 and 5, where the elevation of the head is more important to avoid contamination from surface 20 than is the orientation of the bristles.

The self-righting tendency of these toothbrushes is affected by the nature of supporting surface 20. The rougher and softer the surface 20, the lesser the tendency of the toothbrush to fully right itself.

Other shapes and constructions of toothbrushes are also self-righting, and are within the scope of the following claims. For instance, ballast 24 may be a heavy gel or be injected into a cavity in handle 14 in a liquid state and subsequently solidify. A portion of the handle near the head may include a cavity (e.g. be hollow or filled with a lightweight substance) to result in a proper positioning of the gravitational center. It should also be understood that the curved outer surface of the toothbrush can have small irregularities, such as bumps or grooves, as long as such irregularities are not large enough to substantially impede the tendency of the toothbrush to right itself on a flat, horizontal surface. Some embodiments may be electric-powered.

What is claimed is:

1. A toothbrush comprising a head having a brush portion, and an elongated handle defining a longitudinal axis and having two ends and a curved outer surface extending about a portion of the perimeter of a cross-section of said handle, the brush portion being disposed at one end of the elongated handle and comprising bristles extending in a direction transverse to the axis of the handle, wherein said toothbrush, when placed upon a horizontal surface on said curved outer surface, rotates upon said curved outer surface under gravitational force to a stable position in contact with said horizontal surface at at least two points longitudinally displaced from each other along the handle, in which stable position said head is not in contact with said horizontal surface.

2. The toothbrush of claim 1 wherein said portion of the perimeter includes at least about fifty percent of the perimeter.

3. The toothbrush of claim 1 wherein the part of said curved outer surface in contact with said horizontal surface in said stable position has a center of curvature, said toothbrush having a gravitational center between the curved outer surface and said center of curvature.

4. The toothbrush of claim 3 wherein said handle comprises a barrel-shaped section between said two ends, said barrel-shaped section having a substantially circular transverse cross section of greatest diameter, said gravitational center and said head being disposed on opposite sides of said cross section to elevate said head with the toothbrush at rest upon said horizontal surface.

5. The toothbrush of claim 3 wherein said handle has a substantially cylindrical shape.

6. The toothbrush of claim 3 wherein the handle has a hollow portion between the gravitational center and the head.

7. The toothbrush of claim 1 wherein said head and said handle comprise a molded polymer, said handle further comprising a ballast.

8. The toothbrush of claim 7 wherein said handle includes a cavity, the ballast being disposed within said cavity.

9. The toothbrush of claim 8 wherein said ballast comprises a material that has a material density at least about 20% greater than the material density of said molded polymer.

10. The toothbrush of claim 8 wherein said ballast comprises a gel.

11. The toothbrush of claim 8 wherein said ballast comprises a metal.

12. The toothbrush of claim 7 wherein said ballast comprises a polymer in molded form.

13. The toothbrush of claim 7 wherein said molded polymer comprises a polymer selected from the group consisting of polypropylene, nylon and low-density polyethylene.

14. The toothbrush of claim 7 wherein the ballast comprises a material selected from the group including high-density polyethylene, polyester and metals.

15. The toothbrush of claim 7 wherein at least a portion of said curved outer surface comprises said ballast.

16. A method of protecting the head of a toothbrush between uses, the method comprising (a) grasping a toothbrush having
  a head with a brush portion, and
  an elongated handle having a substantially circular cross-section with a center of curvature,
  said toothbrush having a gravitational center on a side of said center of curvature opposite said head,
  wherein said toothbrush, when placed upon a horizontal surface on said curved outer surface, rotates upon said curved outer surface under gravitational force to a stable position in contact with said horizontal surface at at least two points longitudinally displaced from each other along the handle, in which stable position said head is not in contact with said horizontal surface;

(b) brushing the teeth with said toothbrush; and subsequently (c) placing said toothbrush on a horizontal surface and allowing the toothbrush to come to rest in said stable position with said head spaced apart from said horizontal surface.

17. A personal hygiene implement comprising a first region and a second region spaced apart from the first region, said second region having a barrel-shaped section with a substantially circular transverse cross section of greatest diameter, the implement having a gravitational center, the gravitational center and the first region disposed on opposite sides of the transverse cross section of greatest diameter to elevate said first region with the implement at rest upon a horizontal surface at two spaced apart points.

18. The personal hygiene implement of claim 17 wherein said first region comprises a portion of the implement intended to contact a portion of a user's body in use.

19. A toothbrush comprising a head having a brush portion, and an elongated handle having two ends and a curved outer surface extending about at least fifty percent of the perimeter of a cross-section of said handle, the brush portion being disposed at one end of the handle, wherein said toothbrush, when placed upon a horizontal surface on said curved outer surface, rotates upon said curved outer surface under gravitational force to a stable position in which said head is not in contact with said horizontal surface, wherein the part of said curved outer surface in contact with said horizontal surface in said stable position has a center of curvature, said toothbrush having a gravitational center between the curved outer surface and said center of curvature, wherein said handle comprises a barrel-shaped section between said two ends, said barrel-shaped section having a substantially circular transverse cross section of greatest diameter, said gravitational center and said head being disposed on opposite sides of said cross section to elevate said head with the toothbrush at rest upon said horizontal surface.

20. A toothbrush comprising a head having a brush portion, and a handle having a curved outer surface extending about a portion of the perimeter of a cross-section of said handle, wherein said toothbrush, when placed upon a horizontal surface on said curved outer surface, rotates upon said curved outer surface under gravitational force to a stable position in which said head is not in contact with said horizontal surface;

wherein said head and said handle comprise a molded polymer, said handle further comprising a ballast;

wherein said handle includes a cavity, the ballast being disposed within said cavity; and wherein said ballast comprises a gel.

* * * * *